US008016217B2

(12) United States Patent
Hirasuga et al.

(10) Patent No.: US 8,016,217 B2
(45) Date of Patent: Sep. 13, 2011

(54) DOCUMENT SHREDDING APPARATUS AND DOCUMENT SCRAPPING SYSTEM USING SAME

(75) Inventors: Atsushi Hirasuga, Tokyo (JP); Takashi Furukawa, Tokyo (JP); Koichi Matsumoto, Kawasaki (JP); Toshinori Hirai, Kawasaki (JP)

(73) Assignees: Sanyo Kogaku Co., Ltd., Tokyo (JP); Meiko Shokai Co., Ltd., Tokyo (JP)

( * ) Notice: Subject to any disclaimer, the term of this patent is extended or adjusted under 35 U.S.C. 154(b) by 229 days.

(21) Appl. No.: 12/545,153

(22) Filed: Aug. 21, 2009

(65) Prior Publication Data

US 2010/0044482 A1 Feb. 25, 2010

(30) Foreign Application Priority Data

Aug. 22, 2008 (JP) ..... 2008-213849

(51) Int. Cl.
*B02C 25/00* (2006.01)

(52) U.S. Cl. .... 241/36; 241/100; 241/101.2; 241/101.5; 241/236

(58) Field of Classification Search ..... 241/101.2, 241/236, 36, 101.5, 100
See application file for complete search history.

(56) References Cited

FOREIGN PATENT DOCUMENTS

| | | |
|---|---|---|
| JP | 2000-42440 A | 2/2000 |
| JP | 2004-228684 A | 8/2004 |

*Primary Examiner* — Mark Rosenbaum
(74) *Attorney, Agent, or Firm* — Birch, Stewart, Kolasch & Birch, LLP

(57) ABSTRACT

A document scrapping apparatus is provided which allows the user to visually check again a document in each scrap job and make a final decision as to whether or not to scrap the entire document in each scrap job, thus avoiding an undesired execution of scrap job. The document shredding apparatus 10 comprises: a shredding mechanism 1 to shred sheets of a document S; an information reader 2 to read, for each scrap job, information written on the sheets of document S; an information display 3 to visibly display the document information of each scrap job read by the information reader 2; a temporary accommodation container 4 to temporarily accommodate the document S of each scrap job read by the information reader 2 so that document S cannot be seen from outside, the temporary accommodation container 4 having an extraction door 4*a*, accessible from outside, through which the document S accommodated in the container 4 can be taken out in an exceptional case; a selection means 5 to make a final decision as to whether or not the document S temporarily accommodated in the temporary accommodation container 4 should be scrapped; and a guide mechanism 6 to guide the document S temporarily accommodated in the temporary accommodation container 4 to the shredding mechanism 1 when the selection means 5 has chosen a document scrapping.

9 Claims, 13 Drawing Sheets

DOCUMENT SHREDDING APPARATUS AND DOCUMENT SCRAPPING SYSTEM USING SAME

BACKGROUND OF THE INVENTION

1. Field of the Invention

The present invention relates to a document shredding apparatus to shred scrapped documents and more particularly to a document shredding apparatus with a scanning function capable of reading documents to be scrapped and a document scrapping system using the same.

2. Description of the Related Art

Examples of conventional document shredding apparatus with a scanning function include, for example, Japanese Patent Laid-Open No. 2000-42440 (embodiment of the invention, FIG. 2) and Japanese Patent Laid-Open No. 2004-228684 (embodiment of the invention, FIG. 2).

Japanese Patent Laid-Open No. 2000-42440 concerns a technology that involves reading image information of a document with an image scanner, checking for a keyword in the image information and, if there is a keyword, sending the document to a restore tray without performing a shredding operation by a shredding mechanism, or if a keyword does not exist, executing a shredding operation by the shredding mechanism.

Japanese Patent Laid-Open No. 2004-228684 concerns a system that comprises a scanner unit, a shredder unit, a storage unit in which to temporarily store a document read by the scanner unit, an image display unit to display an image of the document read by the scanner unit, a first transport unit between the scanner unit and the storage unit and a second transport unit between the storage unit and the shredder unit, whereby, based on the image on the image display unit, the system performs a rescanning operation by the scanner unit, an extraction operation from the storage unit or a shredding operation by the shredder unit.

SUMMARY OF THE INVENTION

Japanese Patent Laid-Open No. 2000-42440, however, has a problem that since a decision as to whether the document subject to a scrap job should be shredded or not is made one sheet at a time, it is difficult to deal with a document that is attached with a keyword but which the user want scrapped or a document that is not attached with a keyword but which the user does not want scrapped.

As to Japanese Patent Laid-Open No. 2004-228684, there is the following problem. A selection is made among the rescanning operation by the scanner unit, the extraction operation from the storage unit and the shredding operation by the shredder unit as the document subjected to the scrap job is checked one sheet at a time. Considering the fact that the rescanning by the scanner unit or the extraction from the storage unit is normally very rare, the sheet-by-sheet checking operation on the document that is to be scrapped may become cumbersome.

A technical task of this invention is to avoid an undesired document scrapping in each scrap job by visually checking the document in each scrap job and making a second check as to whether the entire document in each scrap job should be shredded or not.

The invention as claimed in claim 1 provides a document shredding apparatus comprising: a shredding mechanism to shred sheets of a document; an information reader to read, for each scrap job, information written on the sheets of document; an information display to visibly display the document information of each scrap job read by the information reader; a temporary accommodation container to temporarily accommodate the document of each scrap job read by the information reader so that document cannot be seen from outside, the temporary accommodation container having an extraction door, accessible from outside, through which the document accommodated in the container can be taken out in an exceptional case; a selection means to make a final decision on whether or not the document temporarily accommodated in the temporary accommodation container should be scrapped; and a guide mechanism to guide the document temporarily accommodated in the temporary accommodation container to the shredding mechanism when the selection means has chosen a document scrapping.

The invention as claimed in claim 2 provides a document shredding apparatus according to claim 1, wherein the temporarily accommodation container has a bottom plate on which the document of each scrap job read by the information reader is accommodated; wherein the guide mechanism oscillatably supports the bottom plate such that, when the document is temporarily accommodated, the bottom plate is held almost horizontal and that, when the document is led to the shredding mechanism, the bottom plate is held inclined so that a lower end of the inclined bottom plate is situated on the shredding mechanism side.

The invention as claimed in claim 3 provides a document shredding apparatus according to claim 1, wherein the temporary accommodation container has an extraction door fitted with a lock mechanism that can be locked at a closed position.

The invention as claimed in claim 4 provides a document shredding apparatus according to claim 2, wherein the guide mechanism has a paper handling and feeding unit provided at the bottom plate of the temporary accommodation container and which, when the document is guided from the temporary accommodation container to the shredding mechanism, separates the sheets of the document one sheet at a time as it feeds them.

The invention as claimed in claim 5 provides a document scrapping apparatus according to claim 1, further comprising: a first document transport path provided in an apparatus cubicle, the apparatus cubicle having the shredding mechanism installed therein, the first document transport path being adapted to lead the document into the shredding mechanism; and a second document transport path communicating the temporary accommodation container with the first document transport path when the guide mechanism leads the document temporarily accommodated in the temporary accommodation container into the shredding mechanism, the temporary accommodation container being arranged to face the first document transport path.

The invention as claimed in claim 6 provides a document scrapping system comprising:

a user identifier to identify a user of a document shredding apparatus;

the document shredding apparatus claimed in claim 1; and a scrap document management controller to relate user information from the user identifier with all or a part of document information from an information reader of the document shredding apparatus before retrievably storing them, the scrap document management controller also being adapted to manage the document information and the user information for each scrap job.

The invention as claimed in claim 7 provides a document scrapping system according to claim 6, wherein the scrap document management controller stores, from among the document information supplied from the information reader of the document shredding apparatus, at least identifier information indicating a profile of the document.

The invention as claimed in claim 8 provides a document scrapping system according to claim 6, wherein the document shredding apparatus has an elimination unit that can erase the document information in a given scrap job read by the information reader when the selection means has made a final decision not to scrap the document in the scrap job temporarily accommodated in the temporary accommodation container.

The invention as claimed in claim 9 provides a document scrapping system according to claim 6, wherein the document shredding apparatus has a user identifier.

With the invention of claim 1, the user can visually check again a document in each scrap job and make a final decision as to whether or not to scrap the entire document in each scrap job, thus avoiding an undesired execution of scrap job.

With the invention of claim 2, since the temporary accommodation container employs a movable bottom plate configuration, it can be used also as a document supply container.

With the invention of claim 3, since the extraction door of the temporary accommodation container is fitted with a lock mechanism, the extraction door cannot be opened freely. So, there is no concern that the document placed in the temporary accommodation container may be seen from other users.

With the invention of claim 4, the provision of the paper handling and feeding unit to the temporary accommodation container enables a plurality of sheets of a document accommodated in the temporary accommodation container to be separated one sheet at a time as they are introduced into the shredding mechanism.

With the invention of claim 5, it is possible to perform a scrap job not using the information reader while at the same time executing a scrap job using the information reader.

With the invention of claim 6, the user can manage scrap jobs effectively and also visually check again a document in each scrap job to make a final decision as to whether or not to scrap the entire document in each scrap job, thus avoiding an undesired execution of scrap job.

With the invention of claim 7, since the scrap document management control device requires only a small storage capacity, a large number of scrapped documents can be handled and managed.

With the invention of claim 8, a set of document wrongly put into a scrap job can be taken out of the temporary accommodation container through the extraction door and the document information undesirably put in the scrap job be erased.

With the invention of claim 9, the user information and the document shredding apparatus can be related with each other easily.

DETAILED DESCRIPTION OF PREFERRED EMBODIMENTS

Outline of Embodiment

Figure 1:
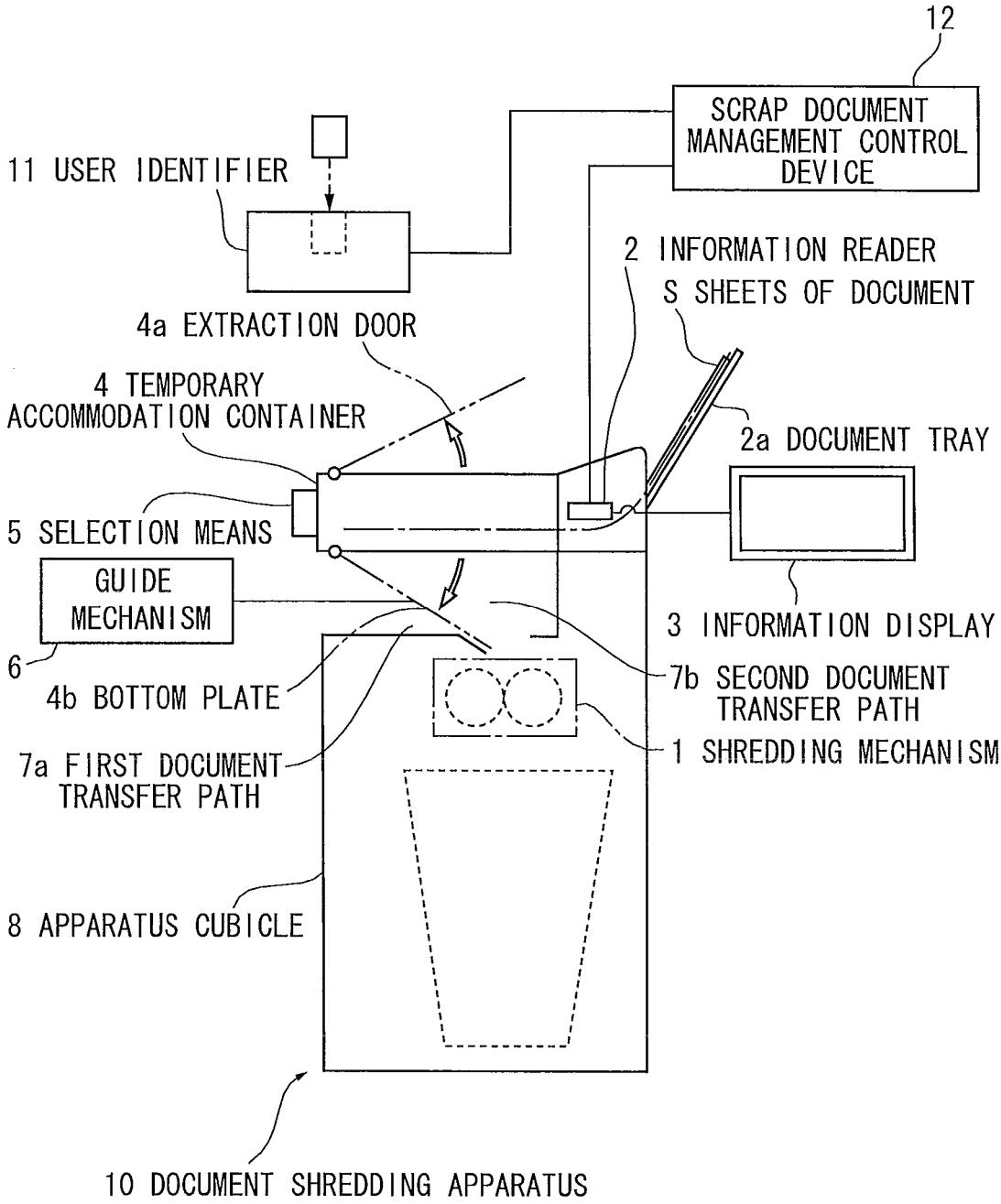
FIG. 1 is an explanatory diagram showing an outline of one embodiment of a document shredding apparatus applying the present invention and of a document scrapping system using it.

FIG. 1 shows an outline of an embodiment of the document scrapping system to which the present invention is applied.

In the figure, the document scrapping system has a document shredding apparatus 10 with an information reader 2 as a scanner to read information of sheets of a document S; a user identifying device 11 to check the identity of a user of the document shredding apparatus 10; and a scrap document management control device 12 that relates user information from the user identifying device 11 to all or a part of document information from the information reader 2 of the document shredding apparatus 10 and stores them so that information can be retrieved together with the associated information, and which manages the document information and the user information for each scrap job.

The document shredding apparatus 10 used in this embodiment comprises a shredding mechanism 1 to shred sheets of a document S into small pieces; an information reader 2 to read information written on the sheets of document S for each scrap job; an information display 3 to display document information read by the information reader 2 for each scrap job so that they can be visibly checked; a temporary accommodation container 4 in which to temporarily accommodate the document S read by the information reader 2 in a way that the document cannot be seen from outside, and which has an extraction door 4*a*, accessible from outside, through which the accommodated document S can be taken out in an exceptional case; a selection means 5 to make a final decision on whether or not to scrap the document S temporarily accommodated in the temporary accommodation container 4; and a guide mechanism 6 to lead the document S temporarily accommodated in the temporary accommodation container 4 to the shredding mechanism 1 when the selection means 5 has chosen the document scrapping.

In such a construction, the shredding mechanism 1 may have any appropriate means, including a pair of shredding blades, for cutting the document S into pieces.

The information reader 2 needs only to be able to read information written on the document S, with its normal reading range preferably covering the entire area in which information of the document is written. The reading range may also be set to cover a predetermined area.

Further, the information display 3, that displays the document information read by the information reader 2, is required to have an enough display range to visibly display the entire document information for one scrap job. For this reason, a display configuration is excluded which can display only a first sheet of a document to be scrapped but not the second and the following sheets.

Further, the temporary accommodation container 4 needs to be able to keep the document from external view and to have the extraction door 4*a*.

Here, "to keep the document from external view" is meant to prevent other users without permission or authority from looking into the document S in the temporary accommodation container 4. And "to have the extraction door 4*a*" is meant to allow the user to take out a document S that is not intended for scrapping but inadvertently thrown into the temporary accommodation container 4. The reason that a construction with no extraction door 4*a* is excluded is to prevent other users from picking up the document S easily from the temporary accommodation container 4.

The selection means 5 needs only to realize the selection function to activate the guide mechanism 6 and may be constructed of a switch to manually or automatically operate the guide mechanism 6.

Further, the guide mechanism 6 may have the following constructions as situations demand. For example, one construction may have a bottom plate 4*b* of the temporary accommodation container 4 set movable so that the position of the bottom plate 4*b* can be changed to lead the document S accommodated in the temporary accommodation container 4 toward the shredding mechanism 1. In another construction, rather than moving the temporary accommodation container 4 itself, a separation and transporting unit may be provided at the temporary accommodation container 4. The separation and transporting unit has an opening formed in the temporary accommodation container 4 which faces a document transfer path extending toward the shredding mechanism 1 so that the document S accommodated in the container, as it is transferred to the shredding mechanism 1, is handled and separated one sheet at a time.

Here, the movable bottom plate assembly as a typical guide mechanism 6 may, for example, be constructed as follows. The temporary accommodation container 4 has a bottom plate 4*b* and accommodates documents S read by the information reader 2 for each scrap job. The guide mechanism 6 supports the bottom plate 4*b* oscillatable so that, when the document S is temporarily accommodated, the bottom plate 4*b* is held almost horizontal and, when the document S is led to the shredding mechanism 1, the bottom plate 4*b* is held tilted to have its lower end situated on the side of the shredding mechanism 1.

Further, a preferred example of the temporary accommodation container 4 may have a lock mechanism built into an extraction door 4*a* to lock the bottom plate 4*b* at the closed position.

Further, from the standpoint of keeping the document guiding performance of the guide mechanism 6 in good condition, a construction may have a separation and transporting unit installed at the bottom plate 4*b* of the temporary accommodation container 4 and which separates the document one sheet at a time as the document S is transferred from the temporary accommodation container 4 to the shredding mechanism 1.

Furthermore, from the standpoint of making it possible for the user to perform a scrap job using the information reader 2 while at the same time executing another scrap job not using the information reader 2, the document shredding apparatus 10 may include a first document transfer path 7*a* and a second document transfer path 7*b*. Provided in an apparatus cubicle 8, in which the shredding mechanism 1 is installed, the first document transfer path 7*a* leads the document S into the shredding mechanism 1, with the temporary accommodation container 4 arranged to face the first document transfer path 7*a*. Also provided in the apparatus cubicle 8, the second document transfer path 7*b* communicates the temporary accommodation container 4 with the first document transfer path 7*a* when the guide mechanism 6 introduces the document S accommodated temporarily in the container 4 into the shredding mechanism 1.

In this embodiment, the user identifying device 11 does not need to be provided in a one-to-one relationship with the document shredding apparatus 10. If one or more of the document shredding apparatus 10 are installed in a document scrapping system room, for example, users who have entered the document scrapping system room may be managed.

However, the provision of the user identifying device 11 for each of the document shredding apparatus 10 is preferred because it makes for an easy link between the user information and the document shredding apparatus 10.

Further, as a preferred example of the scrap document management control device 12 in terms of minimizing a storage capacity, the document information supplied from the information reader 2 of the document shredding apparatus 10 may include at least identifier information representing a profile of a given document.

Furthermore, as to the handling of information on documents erroneously thrown into the temporary accommodation container 4 for scrapping, an elimination unit is preferably provided that can erase the document information in the scrap job read by the information reader 2 if the selection means 5 in the end decides not to scrap a given document temporarily accommodated in the container 4.

Next, how the document shredding apparatus 10 of this embodiment operates will be described as follows.

Figure 2:
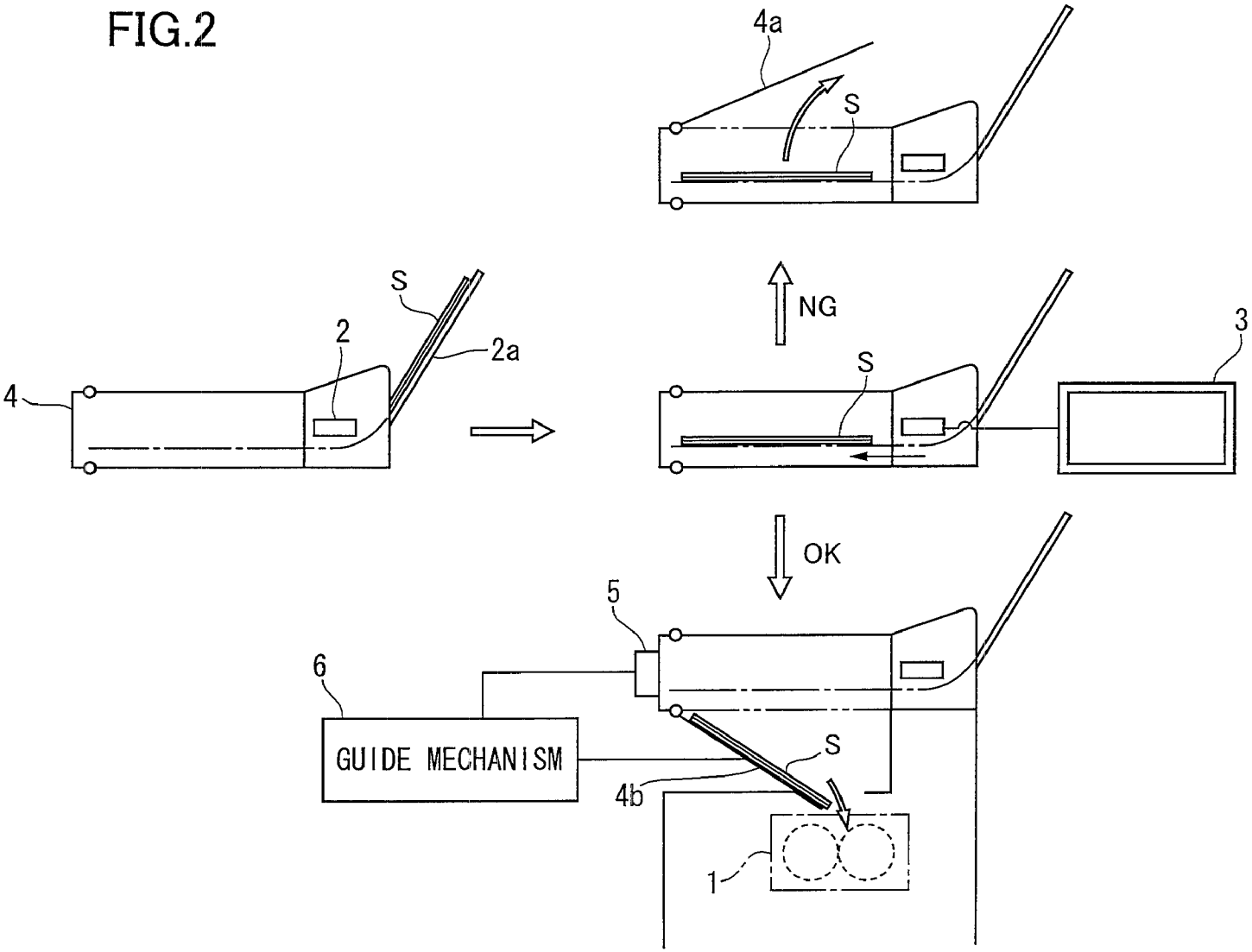
FIG. 2 is an explanatory diagram showing how the document shredding apparatus of FIG. 2 operates.

As shown in FIG. 2, a document S to be scrapped is put on a document tray 2*a* of the information reader 2, read by the information reader 2 and then fed into the temporary accommodation container 4 in which the document S is temporarily accommodated.

In this state, information on the document S read by the information reader 2 is displayed on the information display 3 so that the user is able to check if the document S can really be scrapped.

If the user decides that the document concerned can be discarded (OK for scrapping), he or she can choose a document scrapping with the selection means 5. According to the selection the user has made with the selection means 5, the guide mechanism 6 (of a movable bottom plate type, for example) guides the document S from the temporary accommodation container 4 toward the shredding mechanism 1.

In this state, the scrap document management control device 12 relates the user information from the user identifying device 11 with all or part of the document information from the information reader 2 of the document shredding apparatus 10 and stores them so that information can be retrieved together with the associated information. The scrap document management control device 12 also manages the document information and the user information for each scrap job.

If, on the other hand, the user, having looked at the document information displayed on the information display 3, decides that the document S must not be discarded (NG for scrapping), he opens the extraction door 4*a* of the temporary accommodation container 4, instead of choosing the document scrapping with the selection means 5, to pick up the document concerned temporarily accommodated in the container 4 and stop the document scrapping sequence.

Now, the present invention will be explained in more detail by referring to the accompanying drawings showing example embodiments.

Embodiment 1

Overall Configuration of Document Scrapping System

Figure 3:
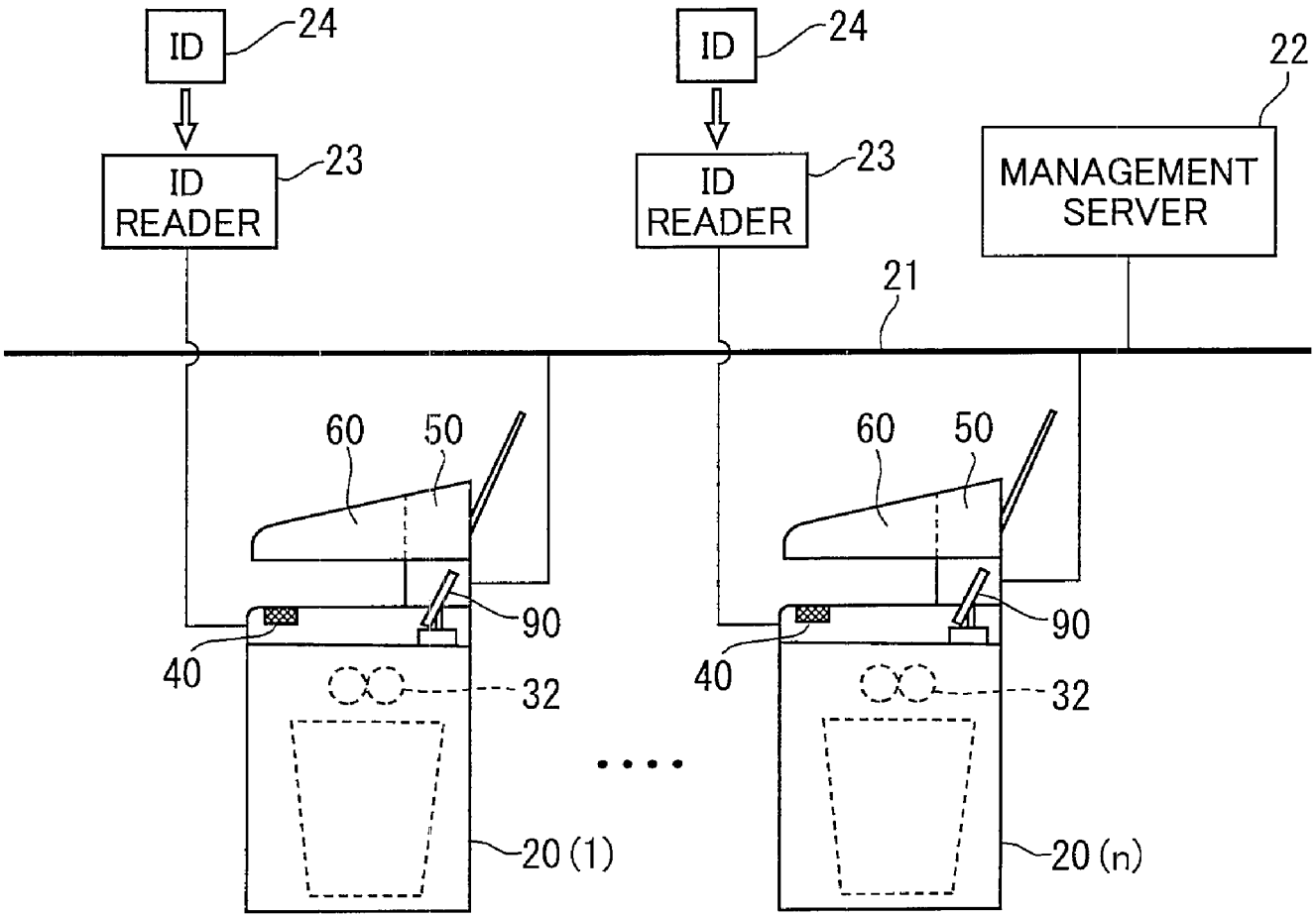
FIG. 3 is an explanatory diagram showing embodiment 1 of the document scrapping system applying the present invention.

FIG. 3 shows the document scrapping system according to Embodiment 1.

In the figure, a plurality of document shredding apparatus 20 (more precisely 20(1)-20(*n*)) are shown connected to a management server 22 via a network 21. Each of the document shredding apparatus 20 incorporates an ID reader 23 to authenticate ID cards 24 held by individual users.

—Document Shredding Apparatus—

Figure 4:
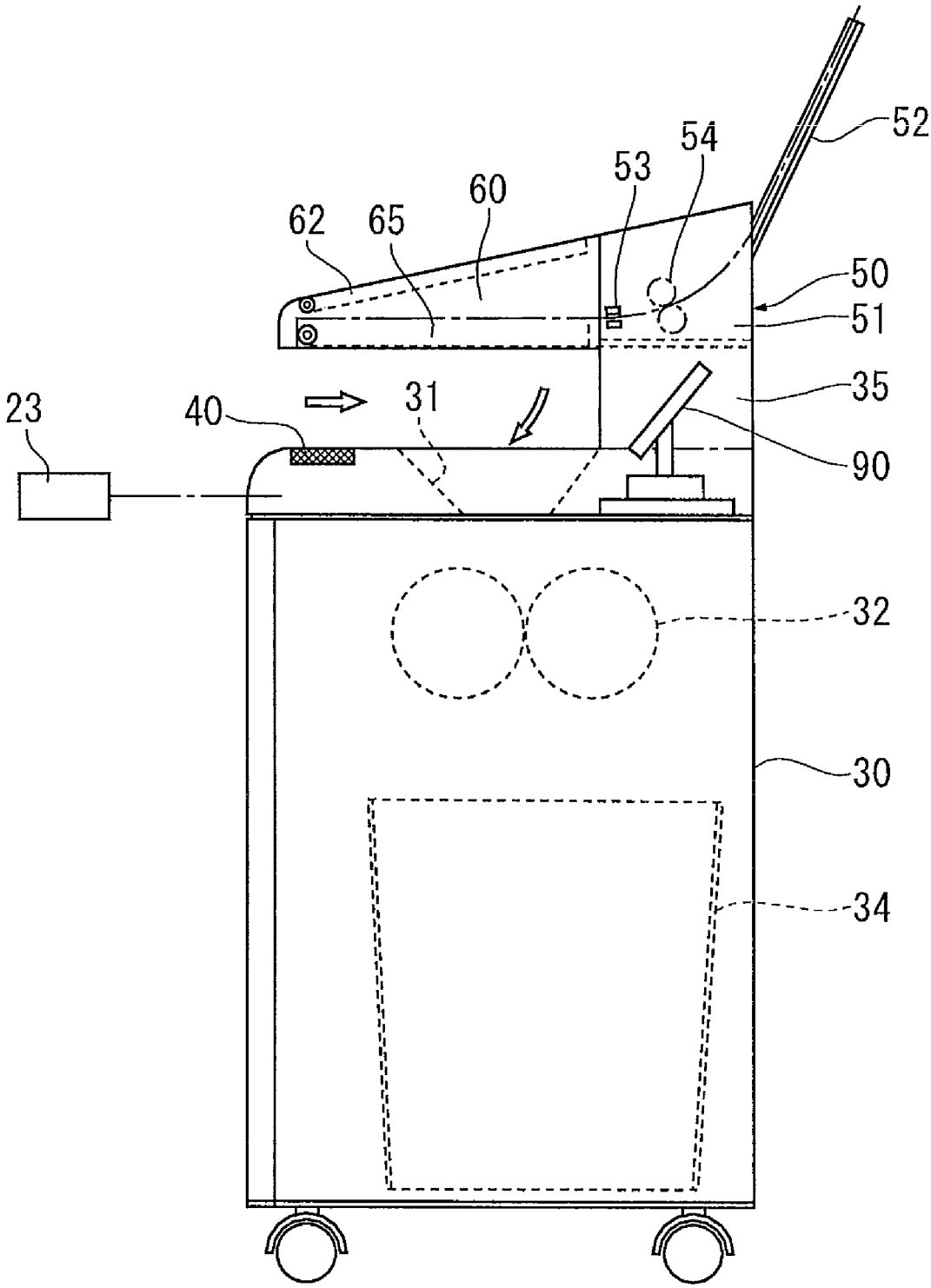
FIG. 4 is an explanatory diagram showing an example of the document shredding apparatus used in embodiment 1.

The document shredding apparatus 20, as shown in FIG. 3 and FIG. 4, has formed in the top portion of an apparatus cubicle 30 a throw-in opening 31 for the document to be scrapped, directly below which is arranged a shredding mechanism 32 that has a pair of shredding blades to shred the document S. Below the shredding mechanism 32 there is a wastepaper basket 34 to receive the shredded document.

On the user operation side (on the left side in the figure) of the top portion of the apparatus cubicle 30, the ID reader 23 and an operation panel 40 with a variety of switches are mounted.

Further, on that part of the top portion of the apparatus cubicle 30 which is opposite the user operation side and adjacent to the throw-in opening 31, there is provided an upwardly rising protrusion 35, on the top of which is arranged a scanner 50. Installed by the side of the scanner 50 is a stock box 60 that is spaced apart from the top portion of the apparatus cubicle 30 and adapted to temporarily accommodate the document S read by the scanner 50.

<Scanner>

In this embodiment, the scanner 50 has a document tray 52 extending at an angle from the rear wall of a scanner enclosure 51. In a document feeding path in the scanner enclosure 51, there are installed an information reading device (e.g., image sensor) 53 and a pair of transport rollers 54.

The document tray 52 is provided with a document sensor not shown that can detect the presence or absence on the document tray 52 of a document S to be scrapped.

<Stock Box>

In this embodiment, the stock box 60 has a boxlike enclosure 61 (see FIG. 5) made of a material that prevents the interior from being seen from the outside. The boxlike enclosure 61 is formed with a passage opening (not shown) at a part adjoining the scanner enclosure 51 through which the document S read by the scanner 50 can pass, allowing the document S fed out by the transport rollers 54 in the scanner 50 to be temporarily stored therein.

Figure 5:
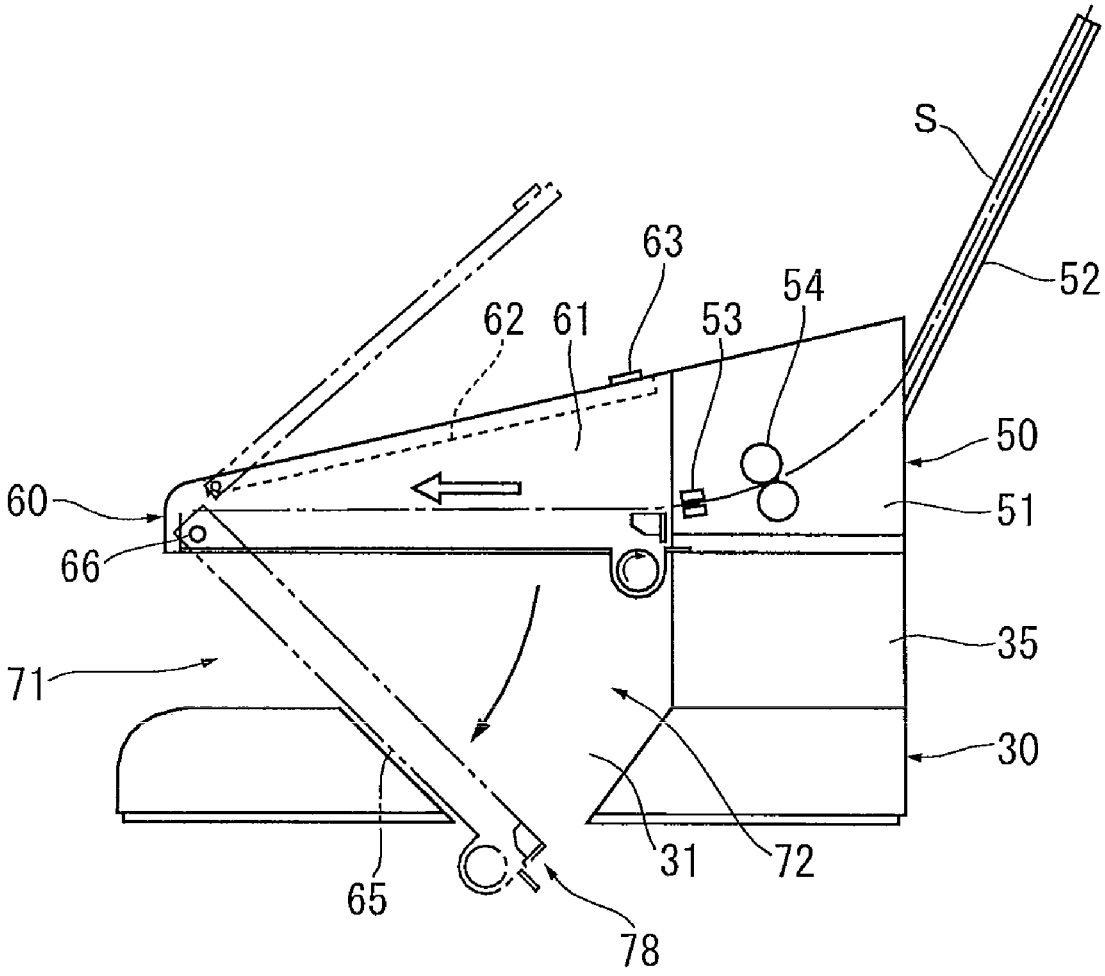
FIG. 5 is an explanatory diagram showing details of a stock box used in embodiment 1.

Further, as shown in FIG. 4 and FIG. 5, at the top of the stock box 60 an extraction door 62 is installed to be opened and closed and which is provided with a lock 63 that can be unlocked with a predetermined key.

Further, a bottom plate 65 of the stock box 60 is mounted oscillatable about an oscillation fulcrum 66 at one end thereof between a closed position, at which it is almost horizontal, and an open position, at which it is downwardly inclined. This bottom plate 65, when open, works as a guide mechanism to guide the document S accommodated in the stock box 60 into the shredding mechanism 32 through a throw-in opening 31.

In this embodiment, as shown in FIG. 4 through FIG. 6, when the bottom plate 65 of the stock box 60 is situated at the closed position, a space between the stock box 60 and the top part of the apparatus cubicle 30 constitutes a first transport path 71 through which the document S to be scrapped is thrown in from the user operation side. When the bottom plate 65 of the stock box 60 is situated at the open position, the first transport path 71 is blocked by the bottom plate 65 and a space immediately below the stock box 60 communicates through the bottom plate 65 to the throw-in opening 31 of the apparatus cubicle 30 to form a second transport path 72.

In the first transport path 71 there is provided a document sensor not shown for checking the presence or absence of the document S.

<Movable Plate Configuration 1>

Figure 6A:
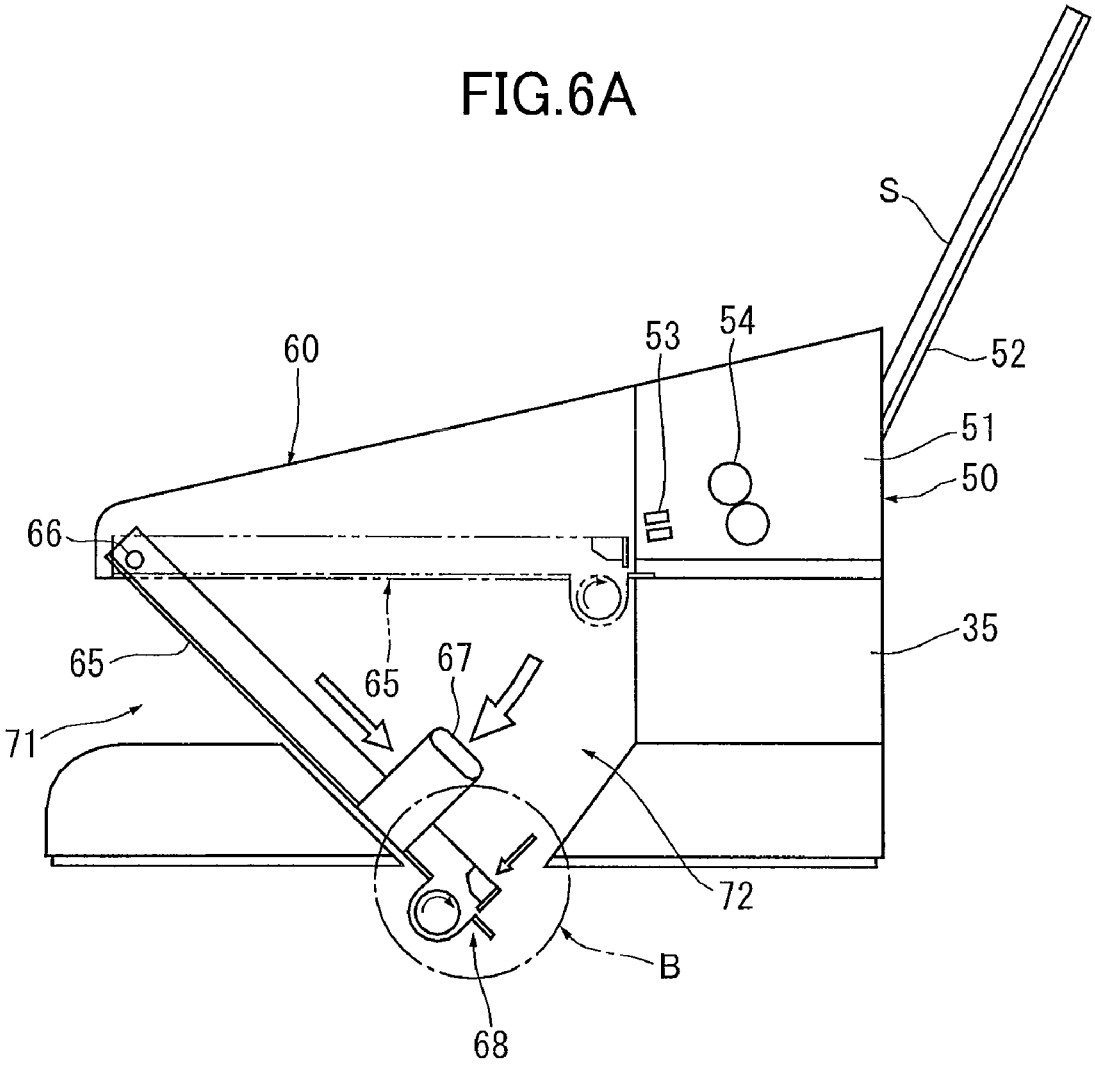
FIG. 6A is an explanatory diagram showing an example of the stock box of embodiment 1 with a movable bottom plate.

In this embodiment, as shown in FIG. 6A, the bottom plate 65 of the stock box 60 is attached with a manual handle 67, for example, by which the bottom plate 65 can be opened or closed.

This manual handle 67 is fixed by, for example, a lock pin which can be moved between an engaged position and a disengaged position. With the lock pin retracted to the disengaged position, the manual handle 67 is disengaged from the lock pin.

Figure 6B:
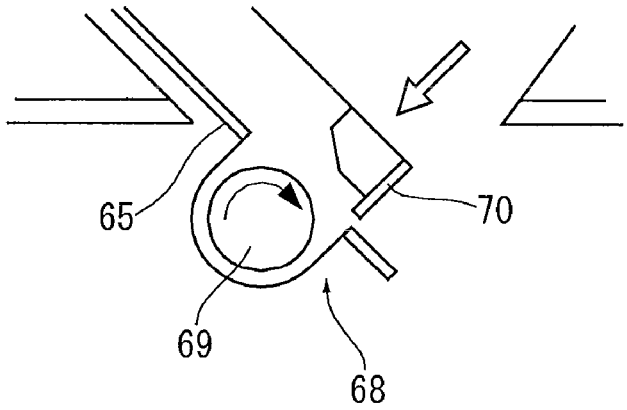
FIG. 6B is an enlarged view of a part B in FIG. 6A.

Further, as shown in FIG. 6A and FIG. 6B in this embodiment, at the lower end of the inclined bottom plate 65 there is provided a paper handling mechanism 68 that separates sheets of document S one sheet at a time. The paper handling mechanism 68 has a paper separation roll 69 and a press plate 70 disposed to face, and adapted to be pressed against, the paper separation roll 69. A feeding force applied to the paper separation roll 69 causes the uppermost sheet of the document S to be separated from the reset by the press plate 70 and forwarded to the shredding mechanism 32.

In the bottom plate 65 of the stock box 60 a document sensor (not shown) for checking the presence or absence of the document S is also provided.

<Movable Plate Configuration 2>

Figure 7:
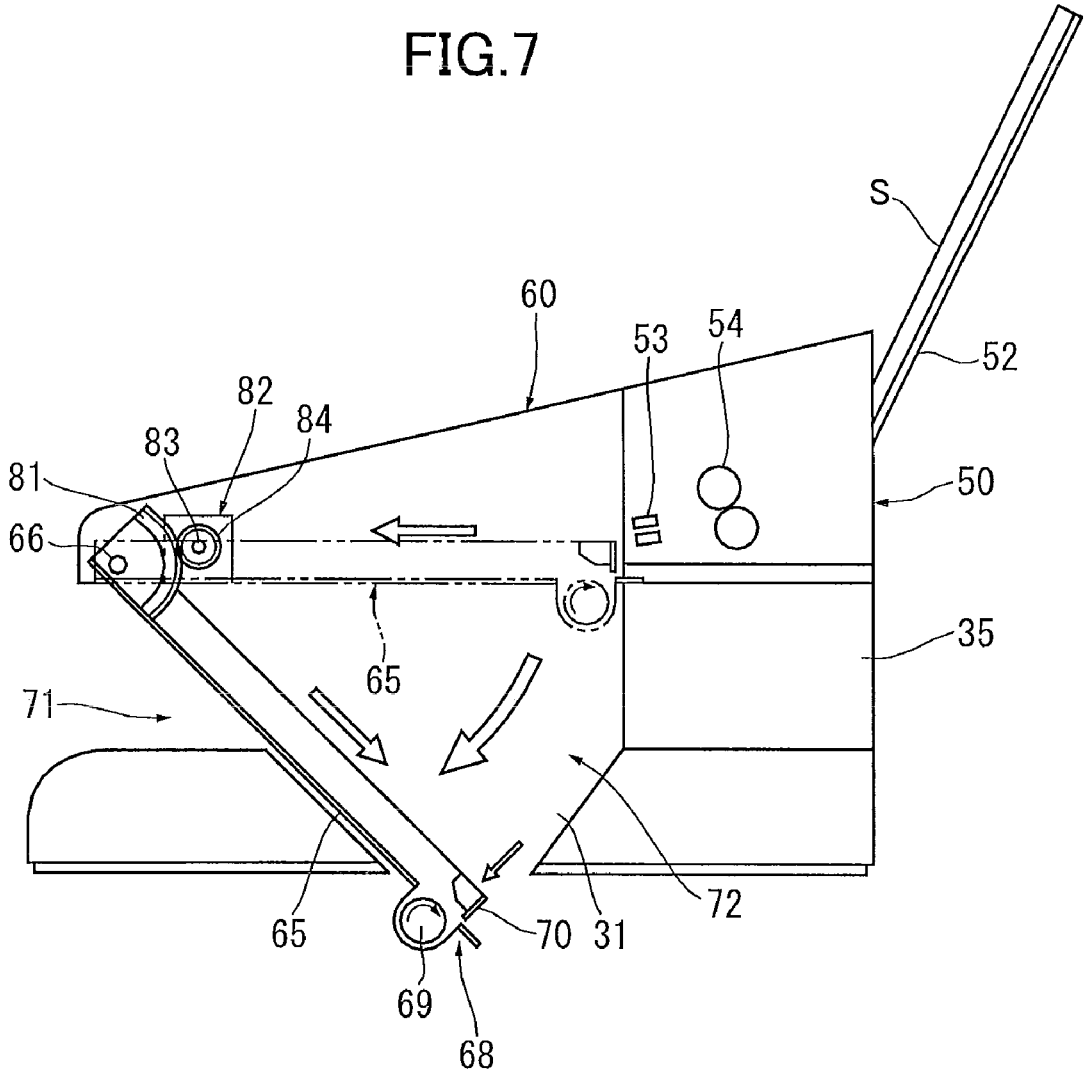
FIG. 7 is an explanatory diagram showing another example of the stock box of embodiment 1 with a movable bottom plate.

The movable plate construction may also be configured as shown in FIG. 7.

In the figure, the bottom plate 65 of the stock box 60 has a transmission gear 81 secured around the oscillation fulcrum 66 and also a reversible drive motor 82 installed at a fixed position in the stock box 60. A drive gear 84 is secured to a shaft 83 of the drive motor 82 and engaged with the transmission gear 81.

In this embodiment, therefore, rotating the drive motor 82 in a predetermined direction a predetermined number of times can cause the bottom plate 65 of the stock box 60 to automatically move from the closed position where it is almost horizontal to the open position where it is inclined downwardly. Rotating the drive motor 82 in an opposite direction a predetermined number of times can cause the bottom plate 65 to return from the open position to the closed position.

<Information Display>

Further, in this embodiment, as shown in FIG. 3, an information display (e.g., liquid crystal display) 90 is provided at the side of the top portion of the apparatus cubicle 30 to display document information read by the information reading device 53 of the scanner 50.

—Control System—

Figure 8:
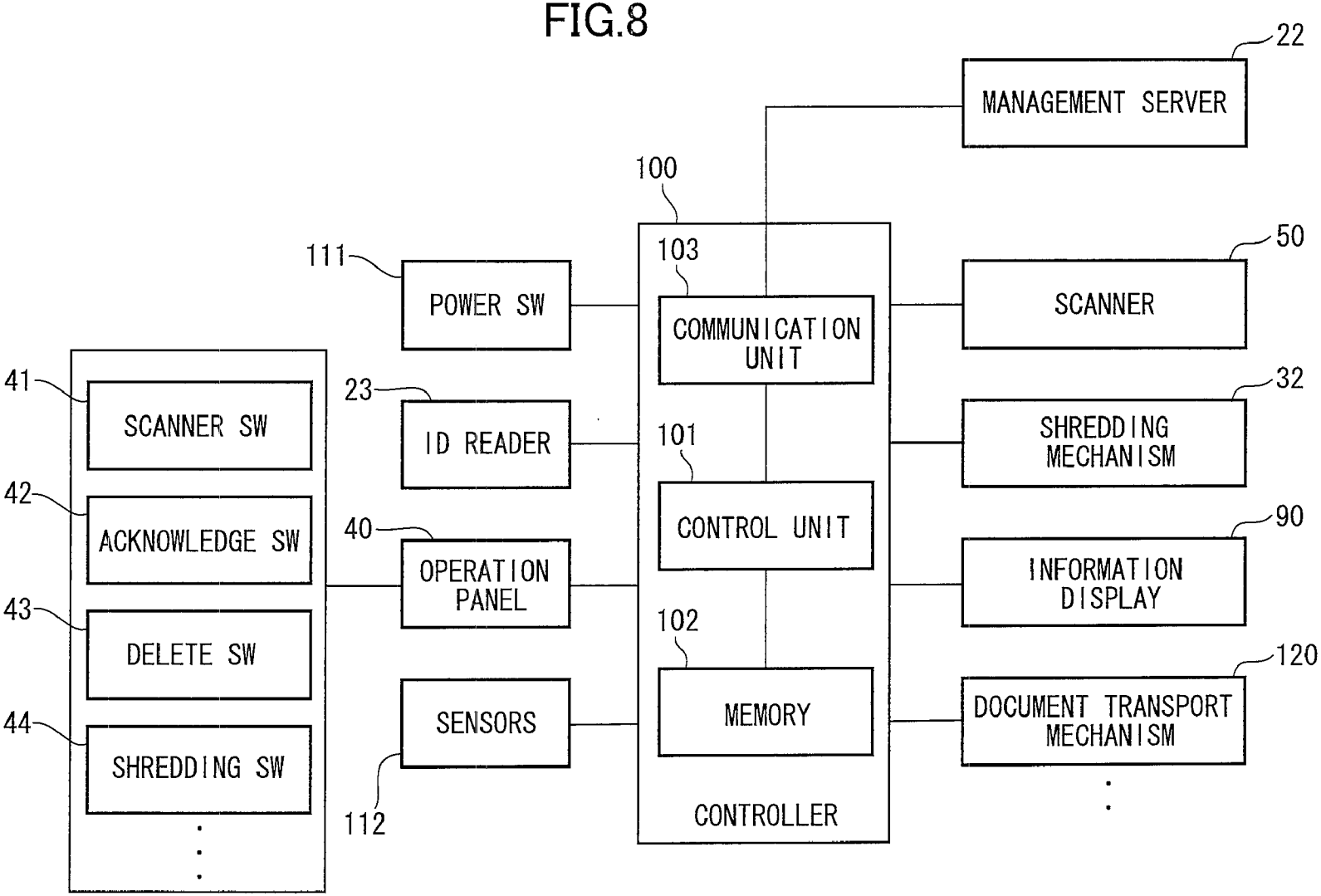
FIG. 8 is an explanatory diagram showing an example of a control system for the document shredding apparatus used in embodiment 1.

FIG. 8 shows a control system of the document shredding apparatus used in this embodiment.

In the figure, denoted 100 is a controller of the document shredding apparatus 20 and comprises a control unit 101 to execute a variety of control operations, a memory 102 to store data transferred from the control unit 101 and a communication unit 103 to communicate with a management server 22 and send management data to it according to instructions from the control unit 101.

To this controller 100 are supplied various signals, including those from a power switch 111 for supplying power to the document shredding apparatus 20 and from ID readers 23, switches on the operation panel 40 and various sensors (e.g., document sensors) 112.

Among the switches on the operation panel 40 are a scanner switch 41 for driving the scanner 50, an acknowledge switch 42 to confirm, by checking the document information displayed on the information display 90, that the document S should be scrapped, a delete switch 43 to erase the document information read by the scanner 50 when the user, after having checked the document information displayed on the information display 90, decides that the document S should not be scrapped, and a shredding switch 44 to drive the shredding mechanism 32.

Figure 9:
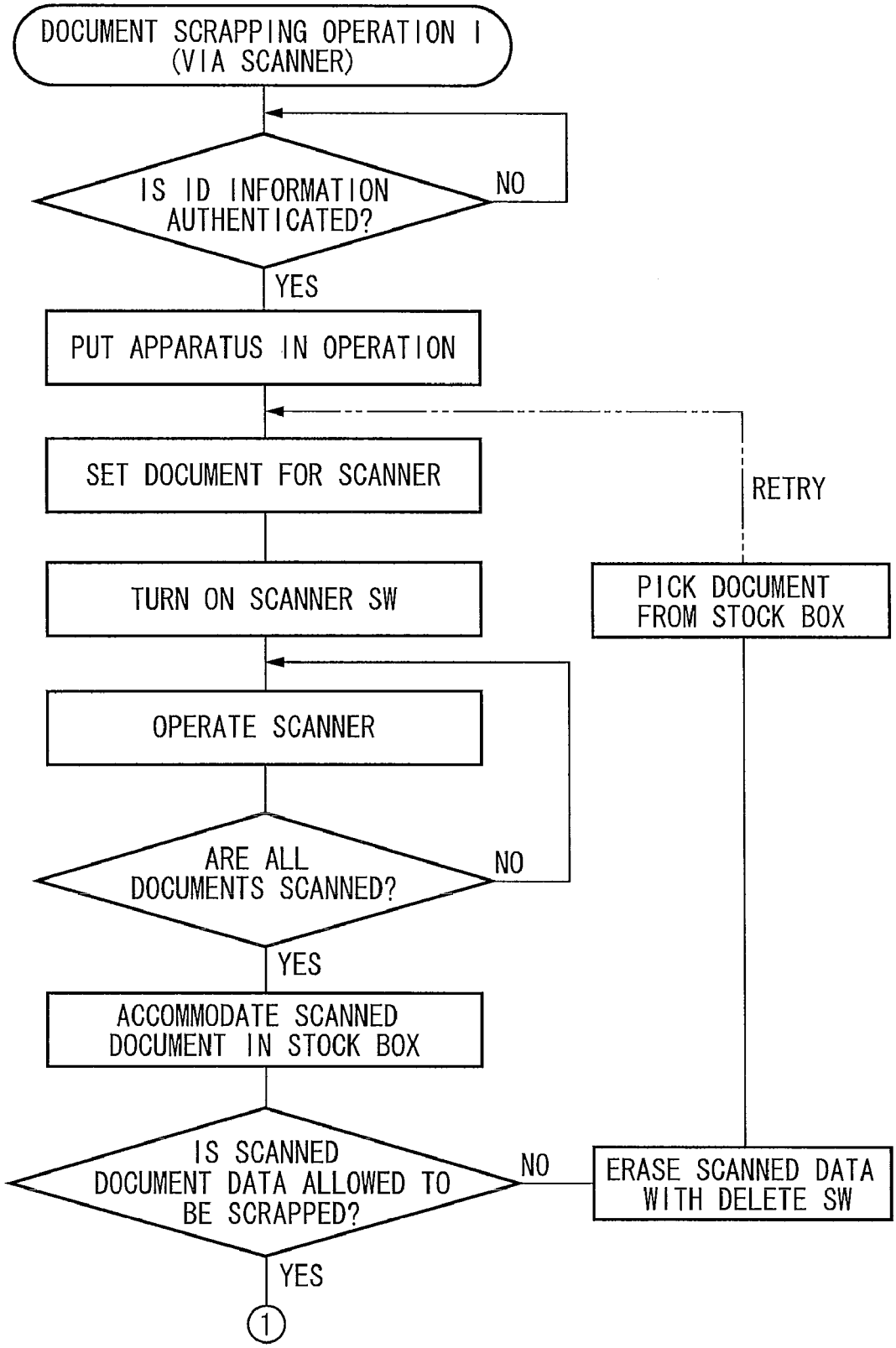
FIG. 9 is a flow chart (1) for a document scrapping operation I (via scanner).
Figure 10:
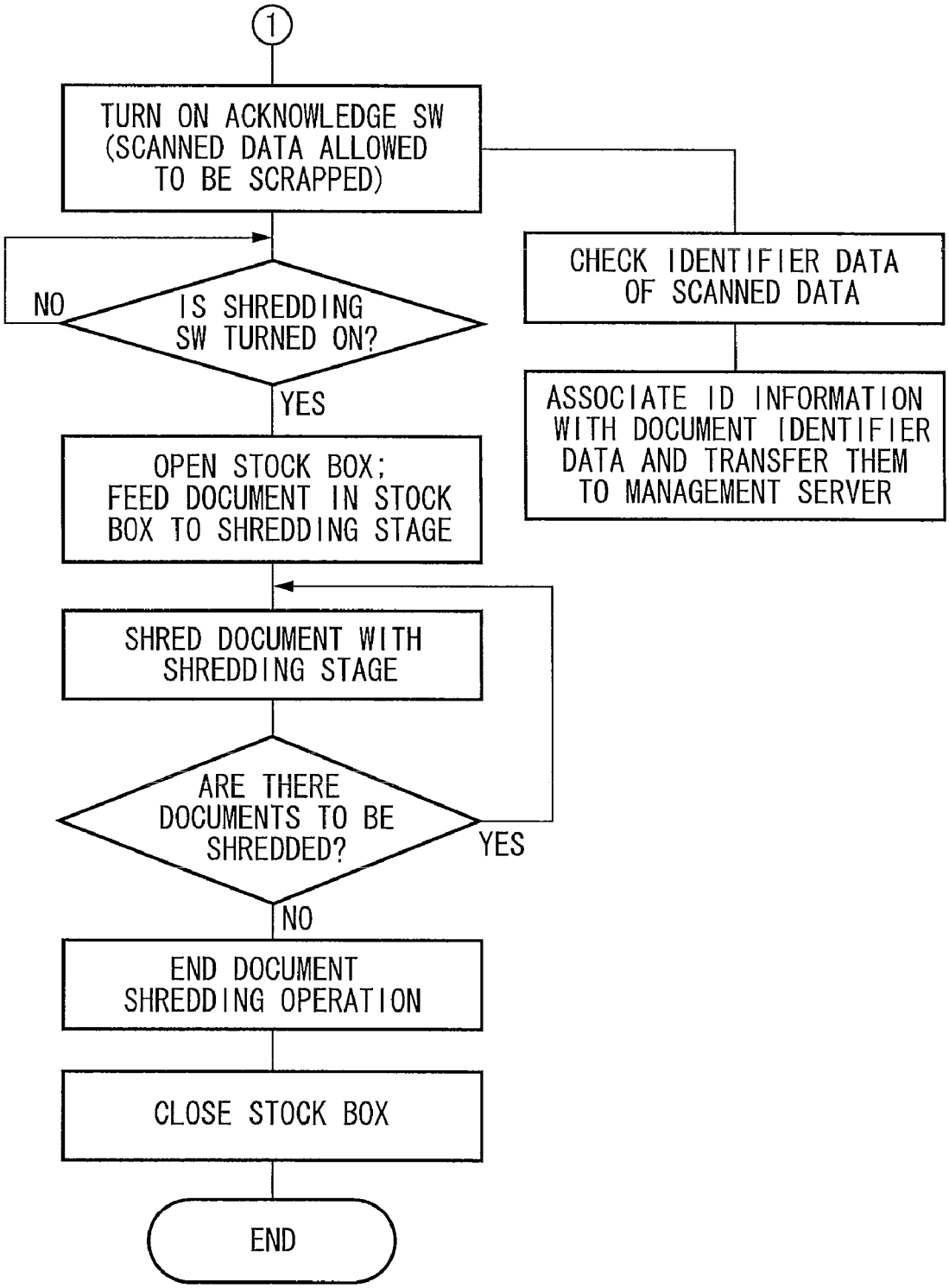
FIG. 10 is a flow chart (2), a second part of the document scrapping operation (via scanner).
Figure 11:
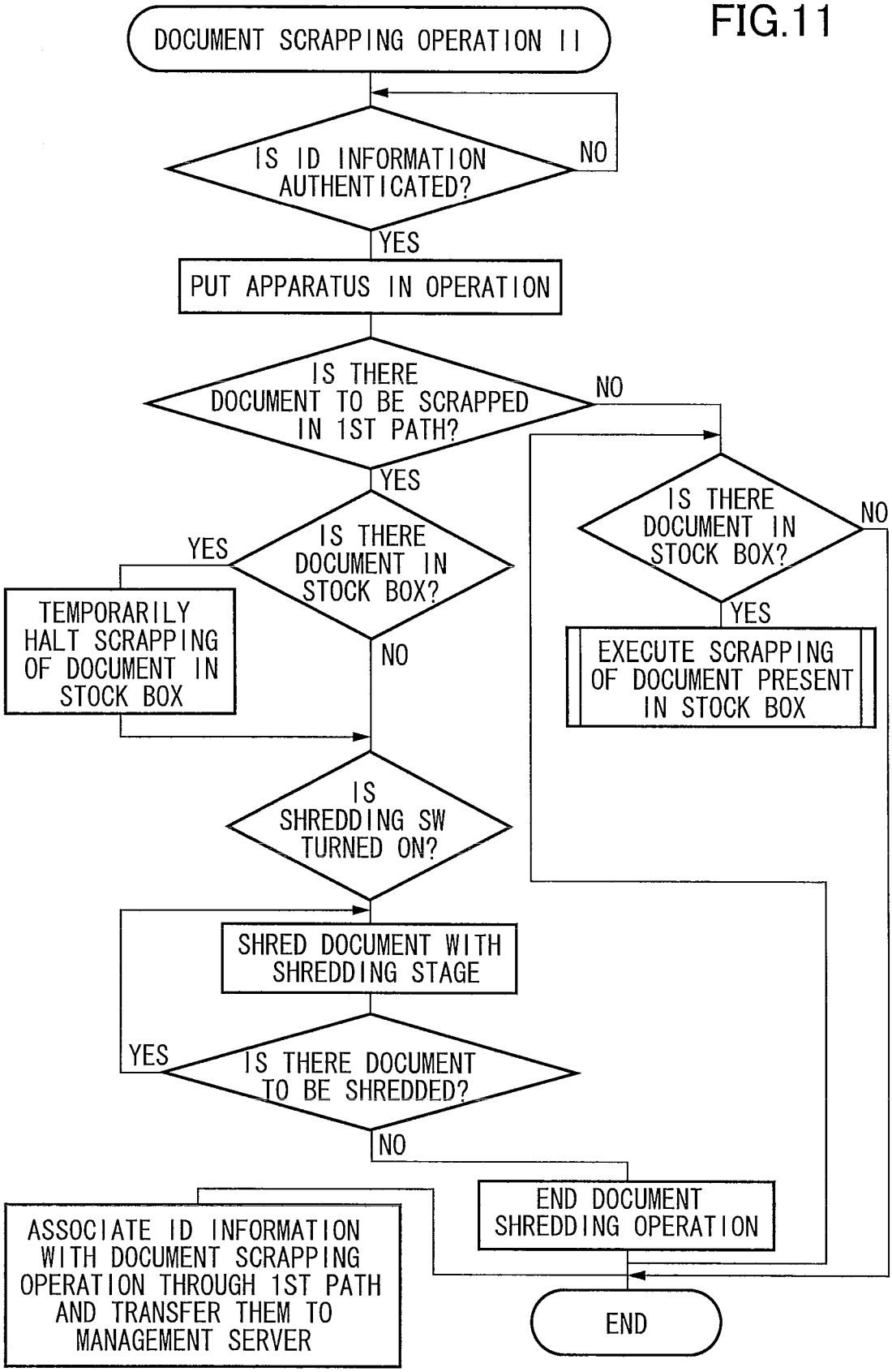
FIG. 11 is a flow chart for a document scrapping operation II.

Then, the controller 100 executes the document scrapping operation I and II shown in FIG. 9 through FIG. 11 and sends predetermined control signals to the scanner 50, the shredding mechanism 32, the information display 90 and a document transport mechanism (e.g., transport rollers 54 for the document S) 120.

—Document Scrapping Operation I (Via Scanner)—

As shown in FIG. 2, FIG. 3 and FIG. 9, the controller 100 authenticates the ID information (user information) by checking the ID card 24 inserted into the ID reader 23. In this state, the document shredding apparatus 20 of this embodiment becomes operational.

Then, a document (scrap job) S to be discarded is placed on the document tray 52 of the scanner 50. When the scanner switch 41 is turned on, the information reading device 53 of the scanner 50 reads the document S one sheet at a time, which is then temporarily stored in the stock box 60 (see FIG. 12).

In this state, the user checks the information of the document S to be scrapped by looking at the information display 90 and decides whether the data read from the document S by the scanner 50 should be allowed to be scrapped.

If, at this time, the user makes a decision to scrap the document, he turns on the acknowledge switch 42 as shown in FIG. 10, sending to the controller 100 a signal indicating that the scanned data is allowed to be scrapped.

At this stage, the controller 100 checks the identifier data of the scanned document S (e.g., bar code and background pattern or watermark) and associates it with the user ID information before transferring them to the management server 22.

The user, after acknowledging that the document S in the stock box 60 can be scrapped, turns on the shredding switch 44 and then moves the bottom plate 65 of the stock box 60 from the closed position to the open position.

Figure 12:
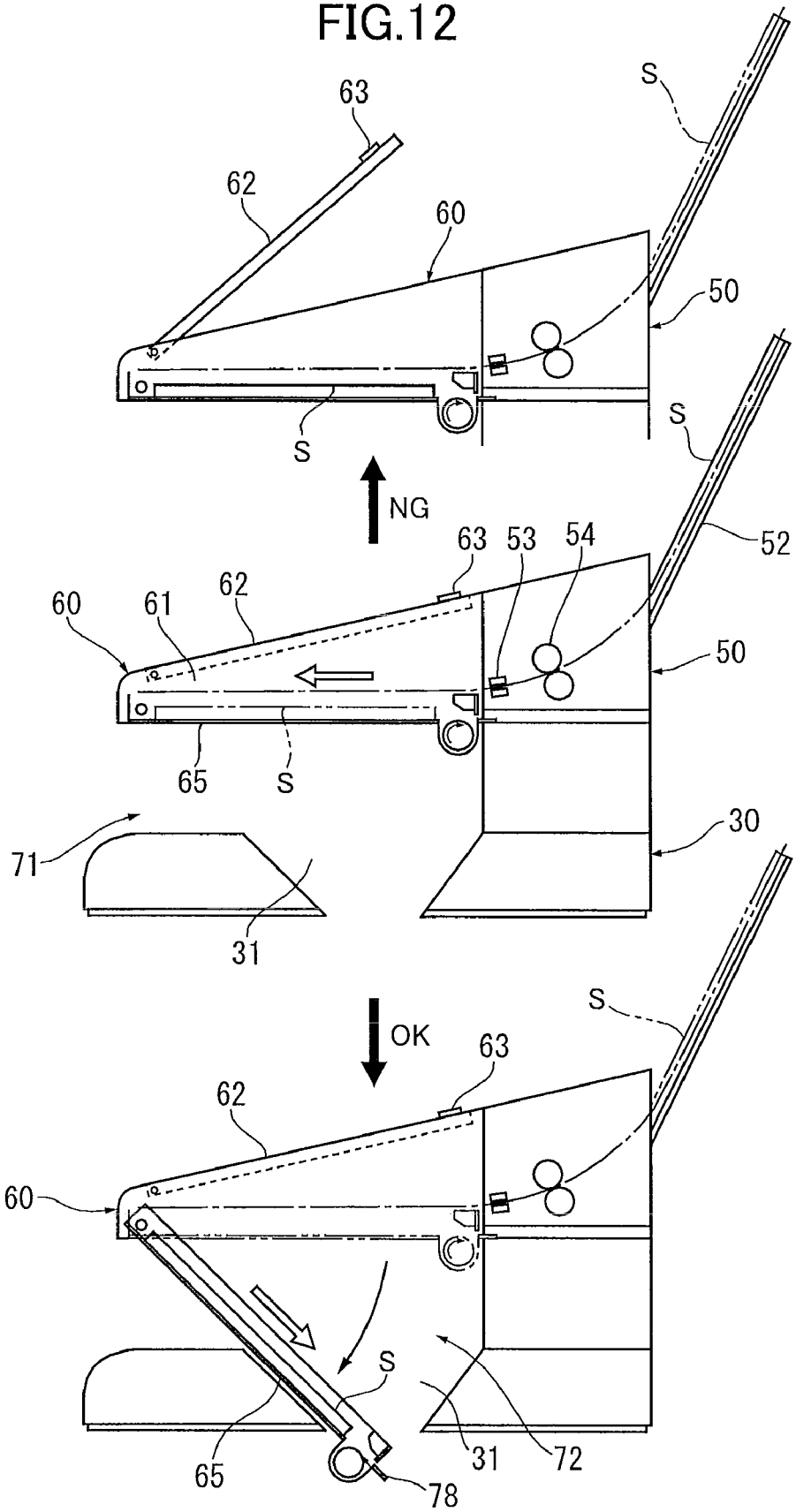
FIG. 12 schematically shows a sequence of operation by the document shredding apparatus during the document scrapping operation I.

After this, the controller 100 sends predetermined control signals to the shredding mechanism 32 and the document transport mechanism 120 to feed the document S from the stock box 60 one sheet at a time to the shredding mechanism 32 which shreds the document S at the shredding stage (see FIG. 12).

Then, when it is detected that the document S to be shredded no longer exists in the stock box 60, the document shredding operation is ended and the bottom plate 65 of the stock box 60 is returned to the closed position manually or automatically.

If the user, after looking at the information display 90, decides that the scanned data of the document S read by the scanner 50 should not be scrapped, as shown in FIG. 9, he or she erases the scanned data with the delete switch 43 and then unlocks the lock 63 of the extraction door 62 of the stock box 60 to take out the entire document S from the stock box 60 (see FIG. 12).

Then, the user removes what he considers must not be scrapped from the picked-up document S and sets only those sheets of the document that he thinks can be scrapped on the scanner 50 again for retry.

If the whole of the document that he has taken out is found not appropriate for scrapping, the user needs to stop the scrap job.

—Document Scrapping Operation II—

A document scrapping operation II, which performs a document scrapping via the scanner 50 and also a document scrapping not via the scanner 50, will be explained by referring to FIG. 11.

As shown in FIG. 2, FIG. 3 and FIG. 9, the controller 100 authenticates the ID information (user information) by checking the ID card 24 inserted into the ID reader 23. In this state the document shredding apparatus 20 of this embodiment becomes operational.

In this state, suppose that the user puts the document S to be scrapped in the first transport path 71. The controller 100 recognizes by the document sensor that there is a document S to be scrapped in the first transport path 71. It also checks whether a document S to be scraped exists in the stock box 60. If there is a document S to be scrapped in the stock box 60, the controller 100 temporarily suspends the operation of scrapping the document in the stock box 60. If there is no document S in the stock box 60, the controller 100 proceeds to the next step.

Figure 13A:
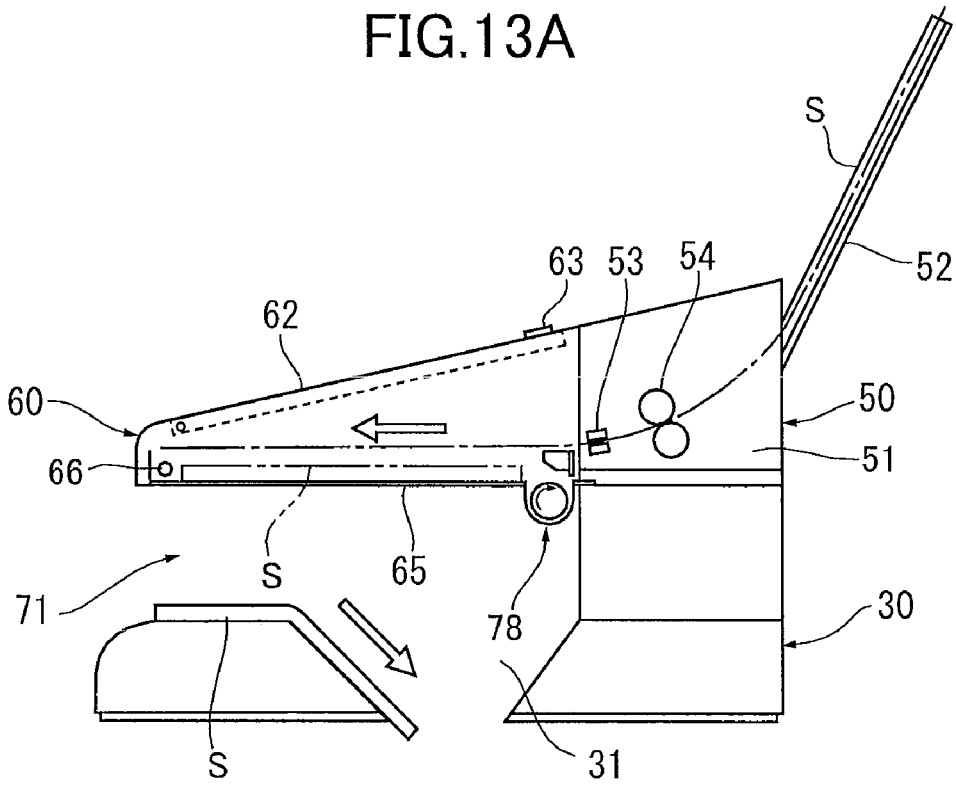
FIG. 13A and FIG. 13B schematically show a sequence of operation by the document shredding apparatus during the document scrapping operation II.

In this state, the controller 100 sends a predetermined control signal to the shredding mechanism 32 and feeds the document S placed in the first transport path 71 into the shredding mechanism 32 in which it is shredded by the shredding stage (see FIG. 13A).

In this embodiment, the controller 100 associates the ID information with the document scrapping operation through the first transport path 71 before transferring them to the management server 22.

Figure 13B:
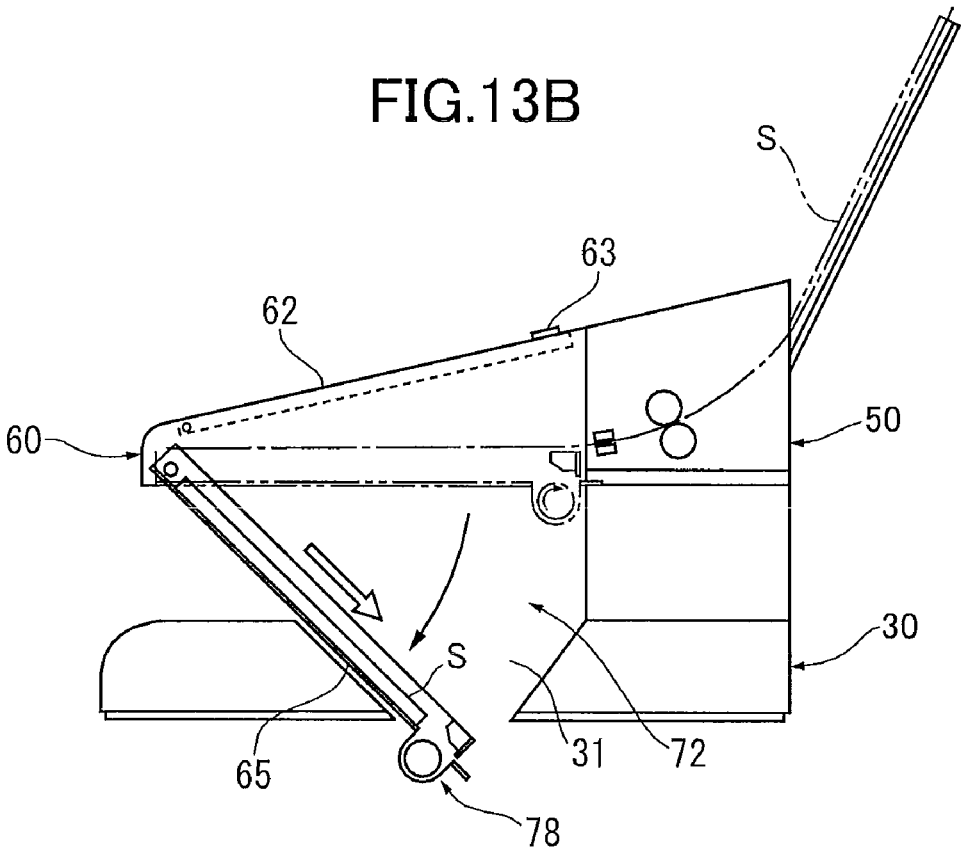

Next, with the document scrapping operation through the first transport path 71 completed, if the document S to be scrapped exists in the stock box 60, the scrapping operation on that document is executed (see FIG. 13B).

If there is no document S to be scrapped in the first transport path 71, the controller 100 then checks for the presence or absence of a document S in the stock box 60. When a document S to be scrapped exists in the stock box 60, the controller 100 executes the operation of scrapping that document (see FIG. 13B).

What is claimed is:

1. A document shredding apparatus comprising:

a shredding mechanism to shred sheets of a document;

an information reader to read, for each scrap job, information written on the sheets of document;

an information display to visibly display the document information of each scrap job read by the information reader;

a temporary accommodation container to temporarily accommodate the document of each scrap job read by the information reader so that document cannot be seen from outside, the temporary accommodation container having an extraction door, accessible from outside, through which the document accommodated in the container can be taken out in an exceptional case;

a selection means to make a final decision on whether or not the document temporarily accommodated in the temporary accommodation container should be scrapped; and a guide mechanism to guide the document temporarily accommodated in the temporary accommodation container to the shredding mechanism when the selection means has chosen a document scrapping.

2. A document scrapping apparatus according to claim 1, wherein the temporarily accommodation container has a bottom plate on which the document of each scrap job read by the information reader is accommodated;

wherein the guide mechanism oscillatably supports the bottom plate such that, when the document is temporarily accommodated, the bottom plate is held almost horizontal and that, when the document is led to the shredding mechanism, the bottom plate is held inclined so that a lower end of the inclined bottom plate is situated on the shredding mechanism side.

3. A document scrapping apparatus according to claim 1, wherein the temporary accommodation container has the extraction door fitted with a lock mechanism that can be locked at a closed position.

4. A document scrapping apparatus according to claim 2, wherein the guide mechanism has a paper handling and feeding unit provided at the bottom plate of the temporary accommodation container and which, when the document is guided from the temporary accommodation container to the shredding mechanism, separates the sheets of the document one sheet at a time as it feeds them.

5. A document scrapping apparatus according to claim 1, further comprising:

a first document transport path provided in an apparatus cubicle, the apparatus cubicle having the shredding mechanism installed therein, the first document transport path being adapted to lead the document into the shredding mechanism; and a second document transport path communicating the temporary accommodation container with the first document transport path when the guide mechanism leads the document temporarily accommodated in the temporary accommodation container into the shredding mechanism, the temporary accommodation container being arranged to face the first document transport path.

6. A document scrapping system comprising:

a user identifier to identify a user of a document shredding apparatus;

the document shredding apparatus claimed in claim 1; and a scrap document management controller to relate user information from the user identifier with all or a part of document information from an information reader of the document shredding apparatus before retrievably storing them, the scrap document management controller also being adapted to manage the document information and the user information for each scrap job.

7. A document scrapping system according to claim 6, wherein the scrap document management controller stores, from among the document information supplied from the information reader of the document shredding apparatus, at least identifier information indicating a profile of the document.

8. A document scrapping system according to claim 6, wherein the document shredding apparatus has an elimination unit that can erase the document information in a given scrap job read by the information reader when the selection means has made a final decision not to scrap the document in the scrap job temporarily accommodated in the temporary accommodation container.

9. A document scrapping system according to claim 6, wherein the document shredding apparatus has a user identifier.

* * * * *